United States Patent [19]

Janssen et al.

[11] 4,398,709

[45] Aug. 16, 1983

[54] WAVE GENERATION AMPLIFICATION APPARATUS FOR CUT SHEET PAPER FEEDING

[75] Inventors: Donovan M. Janssen; Robert Magno; William S. Seaward, all of Boulder, Colo.

[73] Assignee: International Business Machines Corporation, Armonk, N.Y.

[21] Appl. No.: 230,931

[22] Filed: Feb. 2, 1981

[51] Int. Cl.[3] ..... B65H 3/06; B65H 9/16

[52] U.S. Cl. ..... 271/10; 271/37; 271/113; 271/236; 271/251

[58] Field of Search ..... 271/113, 251, 272, 37, 271/120, 119, 250, 236, 10

[56] References Cited

U.S. PATENT DOCUMENTS

| | | | |
|---|---|---|---|
| 282,014 | 7/1883 | Stuart | 271/113 |
| 3,008,709 | 11/1961 | Buslik | 271/113 X |
| 3,276,770 | 10/1966 | Griswold | 271/10 |
| 3,583,697 | 6/1971 | Tippy | 271/10 |
| 3,709,596 | 1/1973 | Ulmer | 271/251 X |
| 4,165,870 | 8/1979 | Fallon et al. | 271/113 X |

OTHER PUBLICATIONS

Anderson, G. D., "Paper Feed Aligner Mechanism," *IBM Tech. Disc. Bull.,* vol. 15, No. 4, Sep. 1972, p. 1253.

Colglazier, D. F. et al., "Combing Wheel Paper Feed," *IBM Tech. Disc. Bull.,* vol. 20, No. 6, Nov. 1977, pp. 2117–2118.

Fallon, J. L. et al., "Sheet Shingler," *IBM Tech. Disc. Bull.,* vol. 21, No. 2, Jul. 1978, pp. 477–478.

Ludwig, J. H. et al., "Paper Parallelism Adjustment . . . ," *IBM Tech. Disc. Bull.,* vol. 21, No. 6, Nov. 1978, pp. 2224–2225.

Hunt, R. E., "Sheet Feeding Apparatus," *IBM Tech. Disc. Bull.,* vol. 21, No. 12, May 1979, p. 4747, 4748–4749.

Klein, W. F. et al., "Multi-Cartridge Sheet Feed . . . ," *IBM Tech. Disc. Bull.,* vol. 21, No. 12, May 1979, pp. 4751–4752.

Rachui, R. A., "Picker Roller Paper Feed . . . ," *IBM Tech. Disc. Bull.,* vol. 22, No. 6, Nov. 1979, pp. 2169–2170.

*Primary Examiner*—Bruce H. Stoner, Jr.

*Attorney, Agent, or Firm*—Francis A. Sirr; Joscelyn G. Cockburn

[57] ABSTRACT

Device for separating and feeding sheets in seriatim from a stack to a processing station. The device includes a pin which periodically contacts and forms a pivot point on the stack. A rotary wave generator is disposed to rotate about the pivot point. The rotary wave generator periodically contacts a topmost sheet in the stack and shingles (that is separates) the sheet from the stack. The shingled sheet is fed into a paper sheet aligner and into the processing station.

9 Claims, 11 Drawing Figures

WAVE GENERATION AMPLIFICATION APPARATUS FOR CUT SHEET PAPER FEEDING

BACKGROUND OF THE INVENTION

1. Field of the Invention

The present invention relates to sheet separating and feeding device, and more particularly, to apparatus for successively separating the top sheets from a stack of sheets and for feeding the successively separated sheets from the stack.

2. Prior Art

The prior art abounds with numerous devices for separating sheets from a stack and feeding the separated sheets. By way of example, U.S. Pat. No. 3,008,709 to Buslik describes a wave generator (sometimes called a combing wheel) for separating sheets from a stack. In the Buslik device, a wave generator is disposed to rotate in a plane parallel to a stack of sheets. The wave generator includes a disc fixedly attached to a rotating shaft. A plurality of free rolling balls are affixed to the disc. The rotating shaft is raised and lowered under the control of a spring and solenoid. The direction of shaft motion is generally perpendicular to the stack. In operation, the rotating disc and free rolling balls are lowered to contact the topmost sheet in the stack. The rotary motion is imparted to the stack and sheets are shingled or separated in a fan-like manner until the topmost sheet is positioned for further feeding.

U.S. Pat. No. 4,165,870 to Fallon et al. describes another prior art rotary shingler device. In the Fallon device, a metal disc is rigidly mounted to a shaft. A plurality of free-rolling wheels or rollers are mounted to the periphery of the disc. The shaft is tiltable about an axis substantially perpendicular to a stack of sheets. A drive means is coupled to the shaft and rotates the disc in a plane substantially parallel to the stack. A sheet feeding assembly including a backup surface and a rotating roller is disposed to form a feed nip relative to the stack. In operation, the shaft is tilted so that one set of the rollers contacts the topmost sheet in the stack. The shaft is then rotated and the sheet is shingled in a linear path away from the feed nip. The shaft is tilted in another direction and another set of rollers contacts the sheet shingling the sheet in the opposite direction into the feed nip.

U.S. Pat. No. 3,583,697 to Tippy is yet another example of the prior art sheet separating and sheet feeding devices. In the Tippy device, a paper stack is disposed in a tray so that the leading edge of the stack forms an angle with an axis of a pair of sheet feed rollers disposed relative to said stack. A single roller is mounted to a rotating shaft. The shaft is mounted above the stack with the periphery of the roller being in driving engagement with the topmost sheet in the stack. The geometric configuration between the elements of the sheet separating and sheet feeding devices are such that the shaft runs in a general direction parallel to the axis of the feed rollers while the single roller is positioned off-center of the stack. As the single roller rotates and is brought into contact with the topmost sheet, the sheet is rotated off the stack with its leading edge in parallel alignment with the feed rollers.

*IBM® Technical Disclosure Bulletin* (TDB) Vol. 21, No. 12, May 1979 (pages 4751–4752) describes a lightweight modular sheet feed and delivery apparatus for attachment to a printer. In the article, two roll wave separators of the type described in the above Fallon et al. patent are disposed for shingling sheets from two removable cassette-type hoppers. Each hopper contains different sizes and/or types of paper. As sheets are shingled from each of the respective hoppers, a pair of feed rollers feeds the shingled sheets towards a common channel. Sensors are disposed relative to each hopper. The sensor senses the leading edge of a shingled sheet and initiates a signal to deactivate the appropriate roll wave separator.

*IBM® TDB* Vol. 21, No. 12, May 1979 (page 4747) describes a roll wave separator of the type described in the Fallon et al. patent. In the article, the roll wave separator is slidingly connected to a shaft. The shaft is disposed relative to a stack of sheets with the roll wave separator floatingly engaged to the topmost sheet in the stack. As sheets are fed from the stack, the roll wave separator adjusts to the stack height, thus eliminating the need for a sheet elevator.

In *IBM® TDB* Vol. 21, No. 12, May 1979 (pages 4748–4749) describes a rotating roll wave separator of the type described in the Fallon et al. patent. The roll wave separator is disposed at the center of a stack of sheets. By contacting the stack with the roll wave separator and simultaneously applying a slight force and rotating said wave separator, a sheet is rotated from the stack.

In *IBM® TDB* Vol. 22, No. 6, November 1979 (pages 2169–2170) shows a picker roller paper feed device with paper depressor element. The device includes a plurality of free-rolling small wheels disposed about the periphery of a disc. When the disc is lowered into contact with a stack, the lower surface of the disc serves as a paper depressor while the free-rolling wheels dislodge a sheet from the stack along a linear path.

*IBM® TDB* Vol. 20, No. 6, November 1977 (pages 2117–2118) describes a combing wheel wave generator coacting with a variable force brake to feed a single sheet from a stack. The combing wheel wave generator is disposed at the front of the stack while the variable force brake is positioned at the rear of said stack. A solenoid controls the brake so that its force on the stack is decreased when the combing wheel is in contact with the stack.

Although the above prior art wave generator sheet separating devices work satisfactory for their intended purpose, there appears to be a lack of control between the devices and sheets in the stack. The lack of control results in double sheet feed from the stack, inconsistent positioning of the sheet relative to a subsequent sheet feed apparatus and relatively long shingle time. It is believed that the lack of control is caused by the fact that the stack is not perfectly flat, therefore, the plane of the paper is not parallel to the plane of the wave generator sheet separating devices. The nonparallelism between the stack and sheet separating device is usually brought about by environmental conditions. For example, humid conditions tend to cause the paper to raise and buckle. Attempts to control the environment tend to be costly and non-acceptable.

SUMMARY OF THE INVENTION

It is therefore a general object of the present invention to provide a more efficient and reliable sheet separator then has heretofore been possible.

It is another object of the present invention to separate and to feed sheets from a stack in a more controlled manner than has heretofore been possible.

The above and other objects of the present invention are achieved through an apparatus having a continuously rotating arm with a plurality of free-rolling rollers rotating about a spring loaded pivot pin to shingle sheets successively from a stack.

In one embodiment of the invention, a sensor means is disposed to sense the leading edge of a shingled sheet and to generate a signal. The signal disables a motor which rotates the arm and enables another motor to retract (that is lift) the arm from contact with a stack of sheets.

In another embodiment of the invention, a sheet feed mechanism accepts and reorientates the sheet for proper entry into a paper aligner. After alignment, the sheet is fed by a pair of servo-controlled rollers into a processing station such as the transfer station of a convenience copier.

The elements of the above sheet separating and sheet feeding device is configured so that the spring load pivot pin is suspended above the stack and off-center thereto. The rotating arm carrying the free-rolling members are also suspended above the stack. The arm is rotated to define a circular trajectory with the pin disposed at the center of said trajectory. The arm and pivot pin assembly is raised and lowered in accordance with the angular position of a sheet relative to the point at which the pivot pin contacts the stack. The sheet feed mechanism includes two pairs of spaced feed rollers mounted onto two rotating shafts. Each pair of rollers coact to form a sheet feed nip. The shafts are disposed in a direction generally parallel to the leading edge of the stack.

The foregoing and other features and advantages of the invention will be apparent from the following more particular description of a preferred embodiment of the invention, as illustrated in the accompanying drawings.

DETAILED DESCRIPTION OF THE PREFERRED EMBODIMENT

As is used in this application, the words "wave generator" and "combing wheel" are used interchangeably. The words refer to the general type of sheet separating devices wherein waves rather than friction are used to separate the topmost sheet from a stack of sheets.

The sheet feeding device to be described hereinafter, finds use with any type of utilization device such as printing presses, convenience copiers, printers, etc. The invention is particularly suited for feeding sheets at high speed to the transfer station of a high performance copier. As such, the invention will be described in this environment. However, this should not be construed as a limitation on the scope of the invention since it is the intent that the invention be applicable to any environment in which it is required for feeding sheets from a stack.

Figure 1:
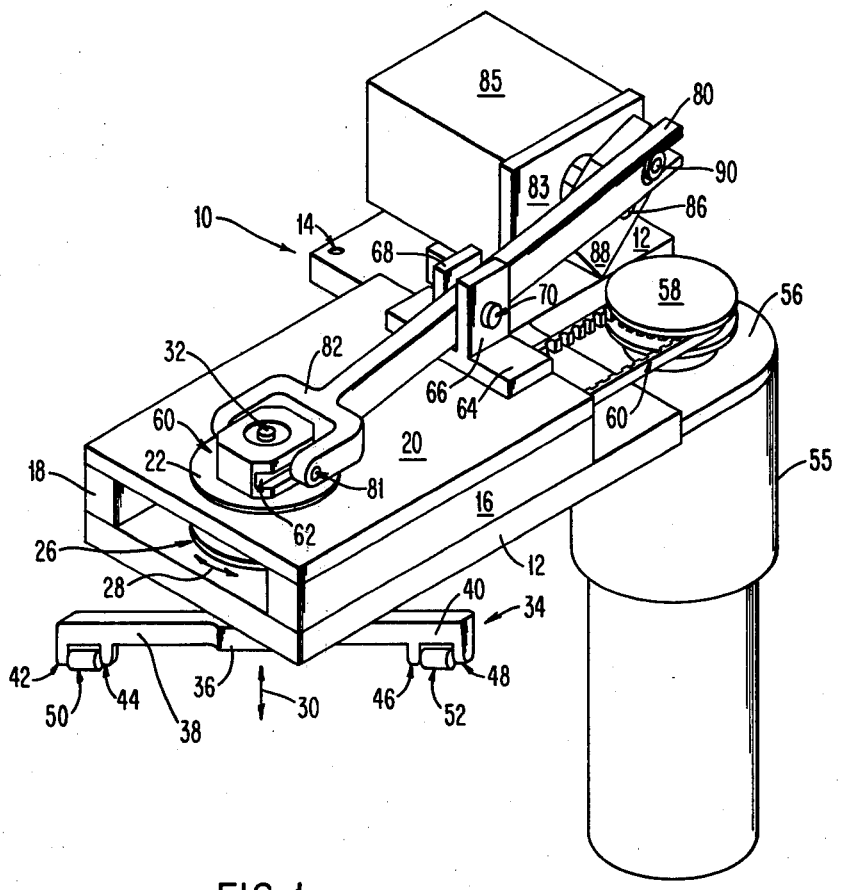
FIG. 1 shows an isometric view of the wave generator sheet separating device.

FIG. 1 shows the sheet separator means 10 according to the teaching of the present invention. The sheet separator means 10 includes a base member 12. The base member is fitted with a plurality of holes suitable to mount the base member and the attached components to a support means (not shown). In FIG. 1, one of the support holes is shown and identified with numeral 14. A pair of rectangular members 16 and 18 respectively are disposed on the surface of base member 12 and extend upwardly therefrom. A rectangular member 20 is fastened onto the top surface of the rectangular members. The orientation is such that the rectangular members 16 and 18 are disposed on the surface of base member 12 in spaced relationship with respect to one another and the rectangular member 20 is disposed in a plane parallel to base member 12 and in spaced relationship thereto. A dual function bearing assembly 17 (FIG. 5) is mounted by disc 22 onto rectangular member 20. A hollow shaft 24 (FIGS. 3, 4 and 5) extend downwardly from the disc 23 through an opening in base member 12. A pulley 26 is mounted to the shaft 24. The pulley is positioned within the opening between the low surface of rectangular member 20 and the upper surface of rectangular member 12.

Figure 3:
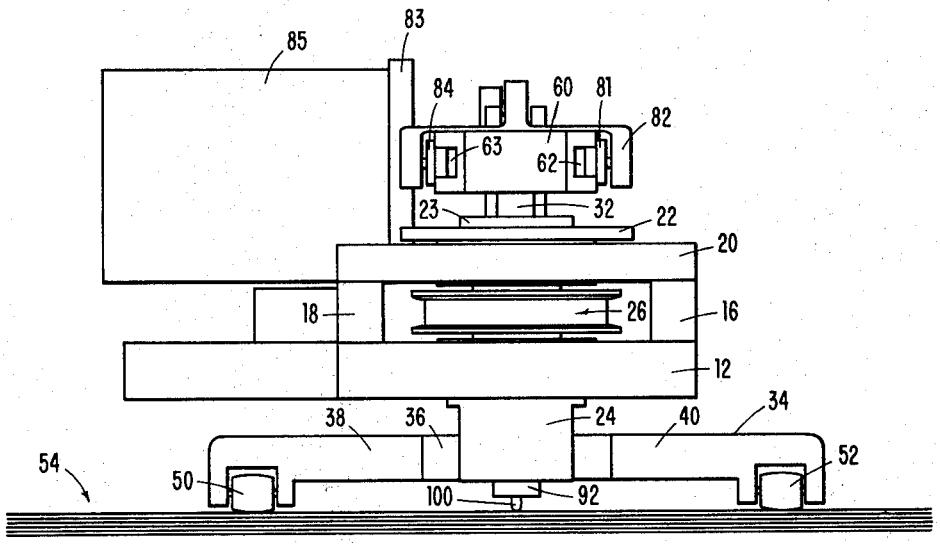
FIG. 3 is a front view of the wave generator sheet separating device with the rotary section of the device lower so that the free rolling elements are in contact with the topmost sheet in the stack.
Figure 4:
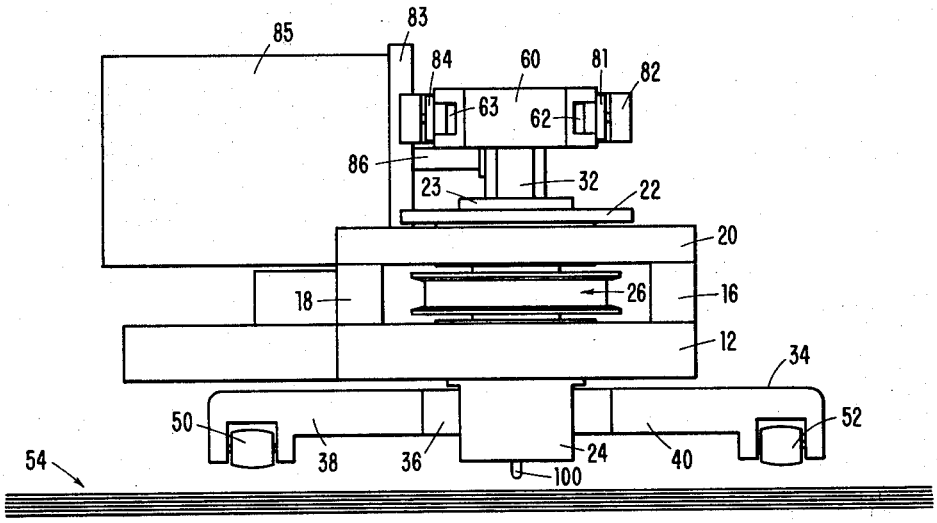
FIG. 4 shows a front view of the device with the rotary section in a raised position.

Referring now to FIGS. 1, 3 and 4 in which identical numerals are used to identify common elements, the shaft 24 extends below the bottom surface of base member 12. As will be explained subsequently, the dual function bearing assembly 17 (FIG. 5) allows rotary motion in the direction shown by arrow 28 and linear motion in the direction shown by arrow 30. A shaft 32 is slidably mounted within the dual function bearing assembly. An elongated member 34 is fixedly mounted to one end of shaft 32. The elongated member tapers from its central section 36 towards the end sections 38 and 40 respectively. Stated another way, the elongated member 34 is wider in the middle than it is at both ends. Projections 42 and 44 are configured in spaced relationship and at one extremity of elongated member 34. Likewise, projections 46 and 48 are positioned in spaced relationship and extend from the other extremity of the elongated member. Mounting pins (one each) are fixedly mounted to each pair of spaced projection and free rolling rollers 50 and 52, respectively, are mounted to the pins. The free-rolling rollers or wheels are preferably performed from a low friction metal or hard plastic. However, it is envisioned within the teaching of this invention, that resilient rubber or other elastomer rollers may be used. In the preferred embodiment of the invention, the rollers are slightly elongated in shape. As will be explained subsequently and as can be seen more clearly in FIGS. 3 and 4, the shaft 32 with its attached elongated member and rollers, can be raised or lowered (that is transported linearly) to contact a stack of sheets 54. Simultaneously with contacting the sheets, the elongated member and free-rolling rollers are rotated by shaft 24 and sheets are shingled from the stack.

Still referring to FIGS. 1, 3 and 4, a drive motor 55 is mounted to a motor support plate 56. The motor support plate 56 is fastened to the lower surface of base member 12. The drive shaft of the motor (not shown) extends upwardly above the top surface of support plate 56. A drive pulley 58 is fixedly mounted to the drive shaft. A drive belt 60 couples pulleys 26 and 58, respectively. As the motor shaft rotates, the rotary motion is transferred through pulley 58 and drive belt 60 to rotate the elongated member 34 and the attached free-rolling rollers 50 and 52 respectively.

Still referring to FIGS. 1, 3 and 4, the upper end of shaft 32 is journaled for rotation in bearing assembly 60. The housing of bearing assembly 60 is octagonal in shape and is fitted with a pair of grooves on opposite sides thereof. In FIG. 1, only one of the grooves is shown and is identified with numeral 62. The other groove is identified with numeral 63 and is clearly shown in FIGS. 3 and 4, respectively. A bracket 64 is fixedly mounted to the upper surface of rectangular member 20. The bracket includes members 66 and 68 respectively. The members are configured in spaced-apart relationship and extend upwardly from base of bracket 64. A pivot pin 70 is mounted in members 66 and 68 respectively. An elongated mechanical arm 80 is pivotally mounted to pin 70. One end of the arm is fitted with a U-shaped member 82 while the other end is bifurcated. Mechanical couplings 81 and 84 respectively are mounted to each side of the U-shaped member. The couplings are disposed to ride in the grooves 62 and 63 of the bearing house. The fit between the mechanical couplings and the bearing house is such that the housing has an oscillatory motion with respect to the couplings.

Still referring to FIGS. 1, 3 and 4, an L-shaped bracket member 83 is bolted to the top surface of base member 12. The configuration is such that the horizontal portion of the L is bolted to the base member and the vertical portion of the L extends upwardly therefrom. An actuator means 85 is fixedly attached to L-shaped bracket member 83. In the preferred embodiment of this invention, the actuator means 85 is a bidirectional rotary motor with shaft 86 of the motor extending through a hole in the L-shaped bracket member. A mechanical coupling 88 is pivotally coupled to the motor shaft. The mechanical coupler is mounted at its central section to the shaft. A pin 90 is fixedly mounted to the mechanical coupler. The pin is mounted at a point off-center from the point at which the mechanical coupler pivots about the shaft 86. The free end of the pin is slidably mounted within the opening in the bifurcated end of elongated arm 80. As will be described subsequently, when the bidirectional rotating motor 85 is activated, it can lower or raise the elongated member 34 so that the free-rolling rollers 52 and 50, respectively, contact the pile of sheets 54. It should be noted that although a bidirectional rotary motor is used for raising and lowering the elongated member 34, other types of actuator means can be used. By way of example, a solenoid could be used to raise or lower the arm.

Turning to FIG. 3 for the moment, as the elongated arm 34 is lowered to contact a stack of sheets, a force generating assembly 92 contacts the stack to form a pivot point therewith. As will be explained subsequently, the elongated member 34 rotates about the pivot point to shingle or separate sheets from the stack.

Figure 5:
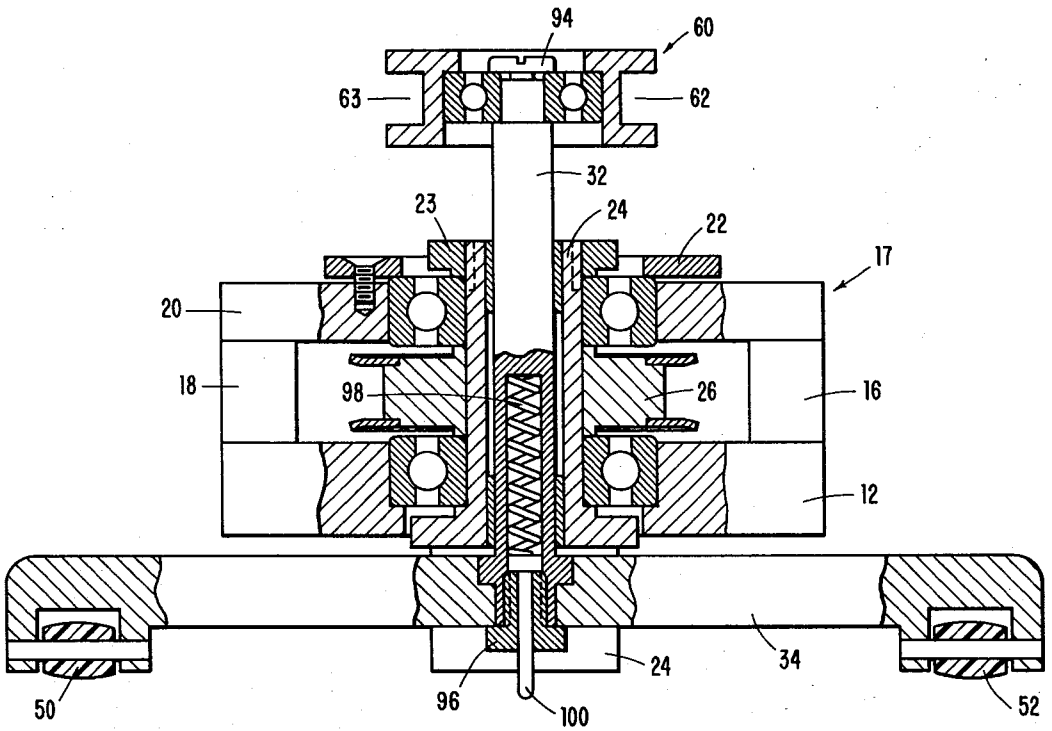
FIG. 5 is a cross-section through the wave generator and the spring loaded pivot pin.

FIG. 5 is a view showing a cross-section of elongated member 34 and the mechanical devices which allow the elongated member to rotate in a plane parallel to a stack of sheets and for linear motion in a plane substantially perpendicular to the plane of rotation. Also, elements which are identical to previously described elements are identified with the previously used numerals. As was stated previously, shaft 32 has both linear and rotary motion. The linear motion enables elongated member 34 to be lowered so that the free-rolling rollers 50 and 52, respectively, contact the topmost sheet in a stack of sheets. One end of shaft 32 is fitted with a shoulder about its periphery. The rotary bearing assembly 60, is mounted to said shoulder. The rotary section of the bearing is coupled to the shaft by fastening means 94. In the preferred embodiment of the present invention, fastening means 94 is a screw. Of course other types of fastening means can be used without departing from the scope of the present invention. Grooves or channel 63 and 62 are fabricated in the bearing housing. As was stated previously, a pair of mechanical members extending from an elongated lever are coupled through sliders into these grooves. By actuating the elongated lever about a pivot point, shaft 32 is transported upward or downward with respect to a stack of sheets. Stated another way, shaft 32 is transported perpendicular to a stack of sheets. It should be noted that rotary bearing assembly 60 only performs a rotary function, and does not allow relative linear motion between shaft 32 and assembly 60.

A linear/rotary bearing assembly 17 is coupled to shaft 32. The linear/rotary bearing assembly 17 allows linear motion of shaft 32 and enables shaft 32 to rotate. The linear/rotary assembly 17 is elongated and is supported at each extremity by a pair of ball bearings. The linear/rotary assembly 17 includes a pulley 26. The pulley is coupled through hollow shaft 24 which is slotted to drive 34. As was stated previously, when a pulley belt 60 (FIG. 1) is coupled to the pulley and motor 55 (FIG. 1) is activated, the shaft 24 is rotated clockwise or counterclockwise. The linear/rotary bearing assembly 17 has a bearing retaining disc 22 which is used for mounting the linear/rotary bearing assembly 17 to the frame of the rotary shingler and a bearing clamp 23 which is used with shaft 24 to capture the bearing assembly and pulley 26. The fit between hollow shaft 24 and shaft 32 is such to allow linear motion between shaft 24 and shaft 32. Since linear/rotary bearing assemblies are state of the art devices, a more detailed description of its mechanical components will not be given. Suffice it to say that the linear/rotary bearing assembly is coupled to shaft 32 and enables the shaft to rotate in a plane perpendicular to a stack of sheets and to translate linearly in a plane perpendicular to the plane of rotation.

Still referring to FIG. 5, the rotary elongated member 34 is fitted by screw 96 to the lower extremity of rod 32. A hole is bored inside of shaft 32 and a coil spring 98 is fitted within the hole. A nail-shaped force application pin 100 is fitted inside the hole. A good portion of the pin member extends from the lower surface of shaft 32. The lower end of coil spring 98 rides on the top of the disc portion of the nail-shaped member. As such, the pin member is biased towards the stack of sheets upon which it rides. As such, when the shaft 32 is positioned so that the external point of nail-shaped member 100 contacts the pile, a force is transmitted through the pin onto the stack. Additionally, the pin forms a pivot point with the stack, and the elongated member 34 rotates about that pivot point. As such, the amplification ratio which each sheet experiences as it is shingled from a stack is greatly enhanced and is independent of the size of the members or sheets in the stack.

Figure 2A:
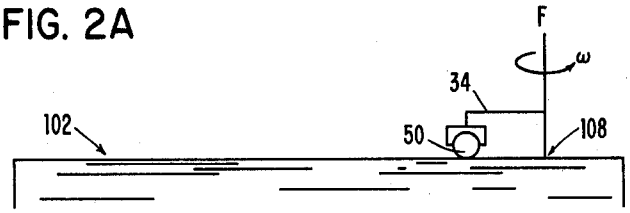
FIGS. 2A and 2B are schematics showing the geometric relation between a shingled sheet and the pivot point whereat a stack of sheets is restrained during shingling. The showing is helpful in understanding the consistency with which a sheet is separated from the stack and the positioning of a sheet feeding device to feed the sheet downstream from the stack.
Figure 2B:
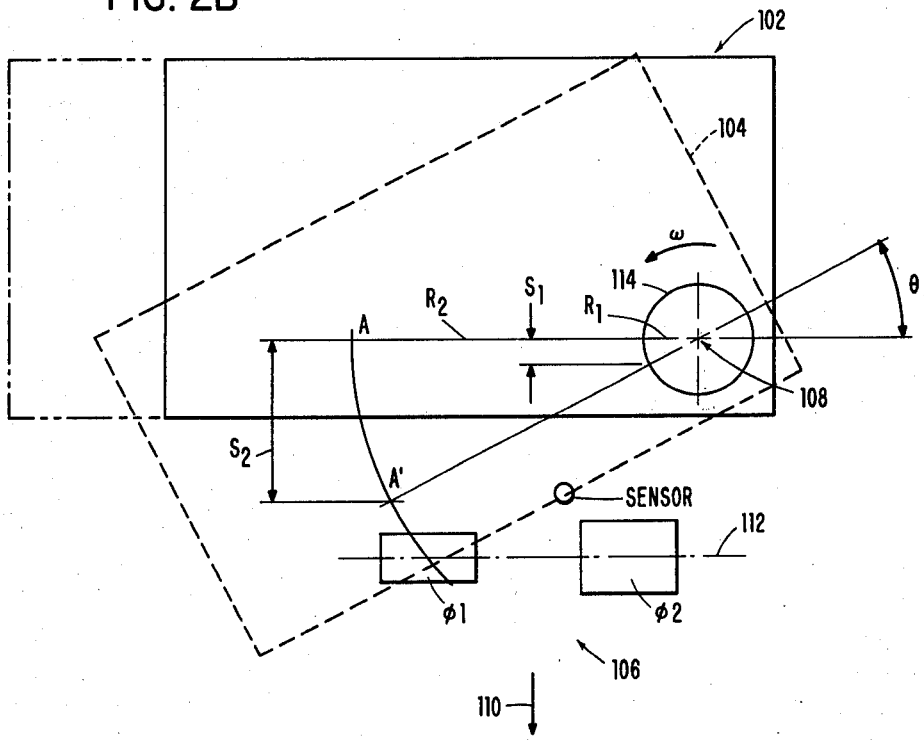

FIG. 2A is a sketch showing a side view of the rotary shingler disposed in a preferred position relative to a stack of sheets 102. FIG. 2B shows the geometric relationship between a sheet 104 as it is rotated from the stack and sheet feed device 106 which is disposed downstream from stack 102. FIGS. 2A and 2B are helpful in understanding the theory which makes the rotary shingler of the present invention more efficient than other prior art rotary shinglers. In FIG. 2A, the pivot pin 100 (FIG. 5) contacts the stack and forms pivot point 108 therewith. The rotary member 34 (FIGS. 3, 4, 5) is rotated in the direction identified by $\omega$. The force (F) is supplied at the pivot point by spring 98 (FIG. 5). In FIG. 2A, only $\frac{1}{2}$ of the elongated member with one free-rolling roller 50 is shown. In actuality, two rollers contact a stack.

Figure 9:
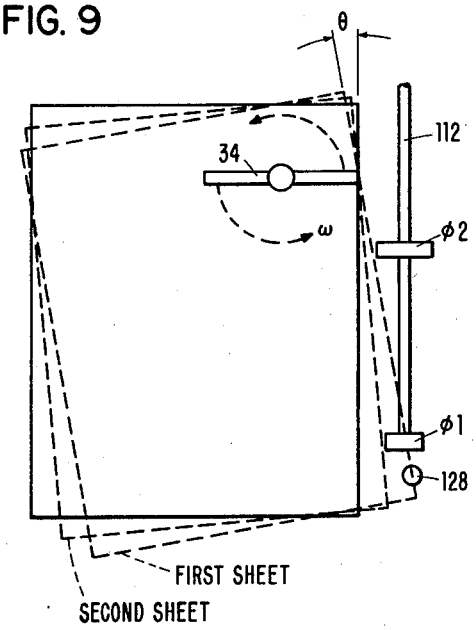
FIG. 9 shows a stack of sheets and a pick sensor disposed relative to fanned-out sheets.

In FIGS. 2A and 2B, the preferred orientation is that the rotary shingler mechanism 10 is placed in the corner of the stack of sheets. Stated another way, the preferred embodiment is that the rotary shingler be placed off-center of the stack of sheets. The pick and feed mechanism 106 is located near the other end. In the preferred embodiment of this invention, the feed mechanism 106 includes feed rollers $\phi$1 and $\phi$2 and a pair of backup rollers (not shown). The feed rollers and the backup rollers (not shown) coact to form feed nips. $\phi$1 is opened and closed upon command. $\phi$2 is always closed. As will be explained subsequently, as a sheet such as 104 is rotated from the stack by the rotary shingler, the sheet falls in the nip and is fed forward in the direction shown by arrow 110. Feed rollers $\phi$1 and $\phi$2 are rigidly mounted to shaft 112. The feed rollers are in spaced relationship on the shaft and the backup rollers (not shown) are disposed relative to the feed rolls to form the feed nip. As was stated previously, the rotating member is mounted to one corner of the stack. The member is rotated in the direction $\omega$. The trajectory which is traced out by the rotating member is identified by circle 114. The center of the circle forms pivot point 108. As is evident from the geometry, sheet 104 and others similarly situated are fanned out from stack 102 in a counterclockwise direction. The rotary member continues to shingle the sheet until the sheet comes under the influence of the sensor. At this point, the sensor outputs a signal and the signal is used to stop the rotary shingler from rotating and also lifts it from the topmost sheet. The sheet is now between the open nip of $\phi$1. Upon machine command, the $\phi$1 nip is closed and the sheet is accelerated into the path 115. The angle of separation $\theta$ is maintained until the sheet comes under the influence $\phi$2. The sheet is then fed and realigned into a regular paper path of a machine. Instead of positioning the sensor at the point shown in FIG. 2B, it can be disposed on axis 112 (FIG. 9). A preferred location is that the sensor be disposed to the left of feed roll $\phi$1. It should also be noted that the diameter of feed roll $\phi$2 is larger than that of feed roll $\phi$1. This difference in geometry attempts to rotate the sheet in a clockwise direction and hence align the edge of the sheet to be parallel with the axis upon which the feed rolls are rotating. Preferred configuration is that axis 112 be parallel to the leading edge of the stack (FIG. 9). In FIG. 2B, the stack 102 carries different size sheets. For example, the sheets form in stack 102 which is identified by solid line defines paper having a first size while the extension of the solid line formed with broken lines represent another size sheet. It should be noted that the effectiveness of the present shingler is independent of sheet size. Stated another way, a sheet such as 104 irregardless of its size, will be shingled off at a constant angle $\theta$. By using the pivot point on the stack, amplification (to be defined) of the shingling motion occurs. Assume in FIG. 2B that R1 equals the radius of the rotary shingler. R2 equals the radius of interest. With pivot point 108 as center, an arc is drawn and on the drawn arc a point A travels from its location on R2 to a second point A'. By observing the geometry of the figure, the following expression can be written:

$R_2/R_1$ = Shingle Amplification Ratio.

Assuming that $R_1$ equals unity, then as $R_2$ increases from $R_1$, the shingle amplification ratio increases. This is an important feature in the present invention, because it enables the pick and feed mechanism 106 to separate sheets more efficiently with a reduced probability of double feed.

If the topmost sheet on stack 102 is shingled until it rotates over the top of the sensor, then the distance $S_1$ (FIG. 2B) that the top sheet moves due to wave generation at the roller is $R1 \times \theta$ and the time to shingle S1 is a function of $\omega$, F, (FIG. 2A) and the paper characteristics. However, in the same time, point A moved a distance $S_2$, which is equivalent to:

$$S_2 = S_1(R_2/R_1)$$

This shows that the angle $\theta$ will be constant for all form lengths, and can be corrected by feeding through two nips of constant angular velocity but different diameters or any other adjustment means. Alternately, if one does not wish to use an intermediate means for adjusting the separated sheet with a paper path of a utilizing apparatus, then the paper tray and the feed assembly can be disposed at an angle $\theta$ with respect to the utilization paper path.

Figure 6:
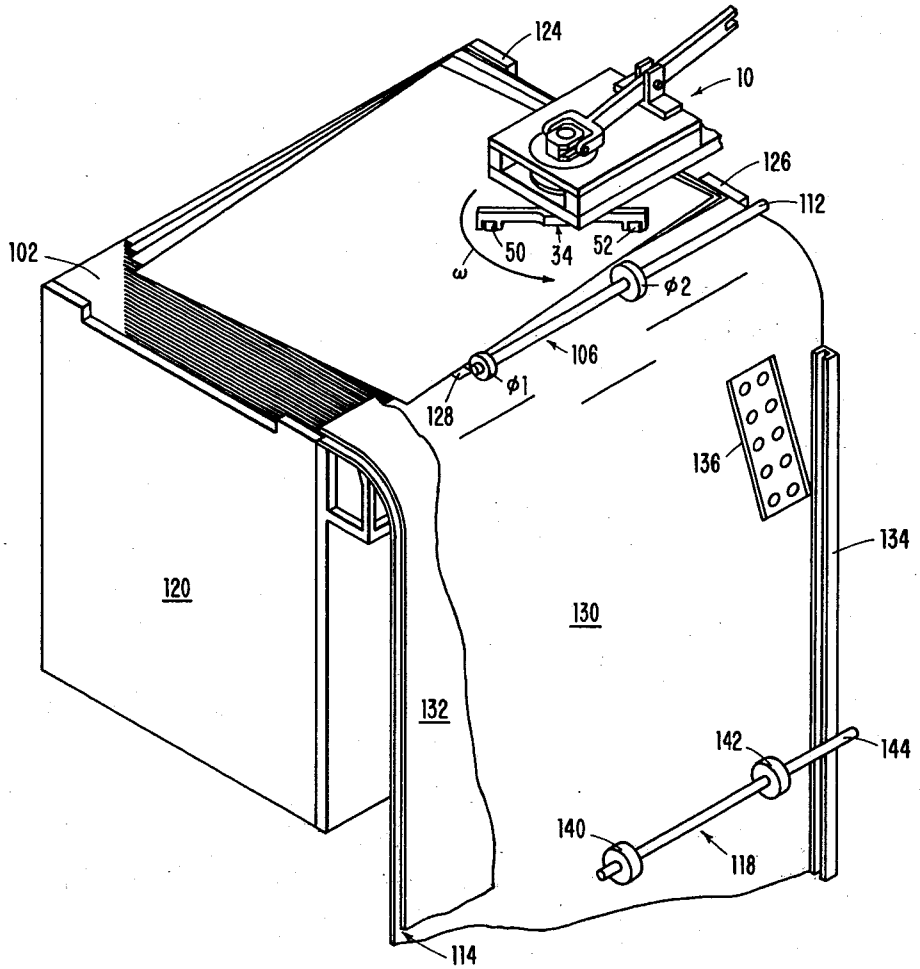
FIG. 6 shows the sheet separating device in combination with a sheet feed mechanism, an aligner and servo-controlled rollers for feeding the sheet into a processing station of a printer.
Figure 7:
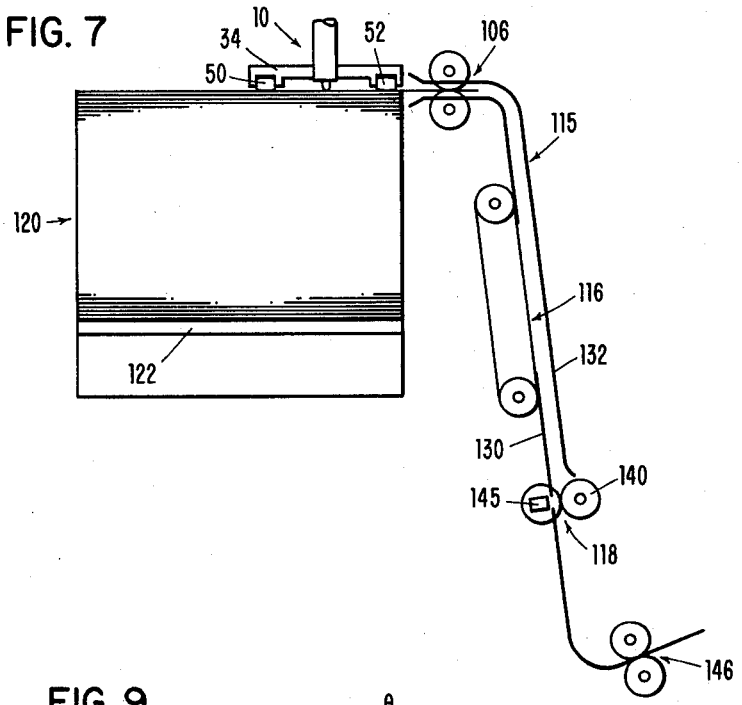
FIG. 7 is a side view of the sheet processing apparatus of FIG. 6.
Figure 8:
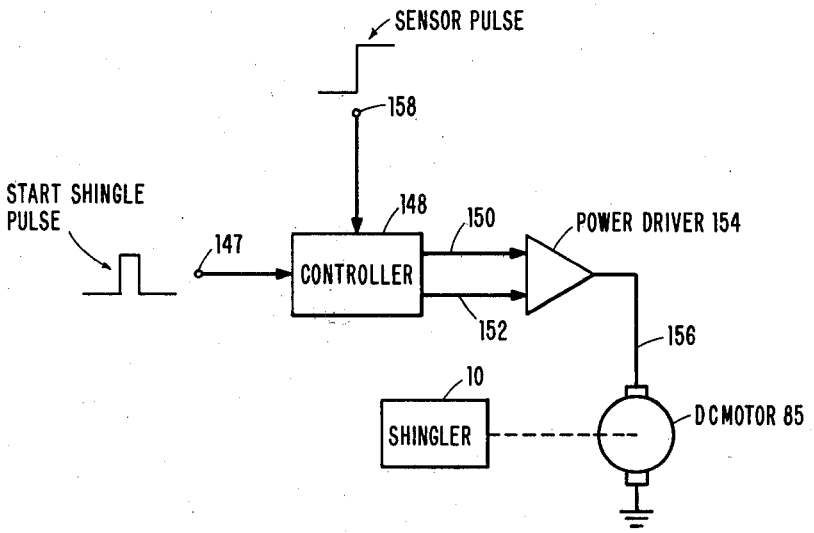
FIG. 8 is a schematic of the electronics which control the shingling device.
Figure 8:
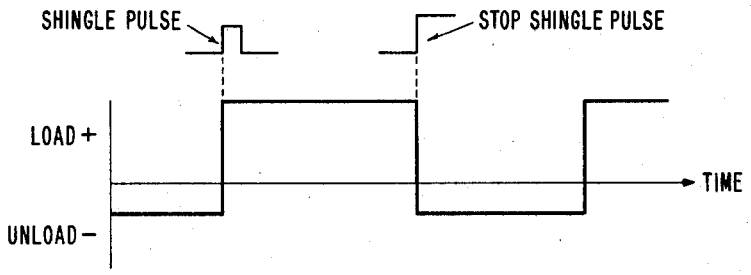

FIGS. 6, 7 and 8 show a modular paper handling apparatus according to the teaching of the present invention. The devices of the modular paper handling apparatus coact to feed sheets in seriatim from the top of a stack into the paper path 115 of a utilization device. From the paper path it is fed into a processing station. In the preferred embodiment of this invention, the paper path is that of a convenience copier and the processing station is the transfer station of said copier. Of course this invention can be applied to other types of utilization devices without departing from the scope of the present invention. Elements in these drawings which are common to previously described elements will be identified by the previously used numerals. The paper handling device comprises of the rotary shingler 10, a sheet pick and feed mechanism 106, a sheet aligner 116 and a servo-controlled gate assembly 118. A paper support bin 120 with a movable support bottom 122 is disposed relative to a paper path 115. A pair of alignment edges 124 and 126 are disposed on one side of the paper support bin. In operation, a stack of sheets 102 are loaded in the paper support bin 120. The edge of the stack is aligned against reference edges 124 and 126, respectively. The rotary paper shingler 10 is disposed above the stack and in one corner thereof. The rotating member 34 with free-rolling rollers 50 and 52 respectively, rotates in the direction shown by arrow $\omega$. As will be explained subsequently, when the pivot pin contacts the top of the stack and the free-rolling elements make the circular motion on the stack, sheets to be fed forward are fanned out from the stack. A pair of feed rollers $\phi$1 and $\phi$2 are mounted in spaced relationship on rotating shaft 112. The configuration is disposed so that the shaft is parallel to the edge of the aligned stack in the support bin. Pick sensor 128 is disposed relative to the shaft and senses when a sheet is fanned from the top of the stack. The signal outputted from the sensor is used to inhibit the rotary member from rotating and ultimately lifting the same from the stack.

Turning to FIG. 9 for the moment, a sketch of the pick sensor and the feed nip relative to the stack is shown. The sketch also shows the relationship of the sheets as they are shingled from the stack. Also, the constant angle $\theta$ at which the sheet leaves the stack is shown. In the preferred embodiment of this invention, $\theta$ is approximately 10°.

Figure 10:
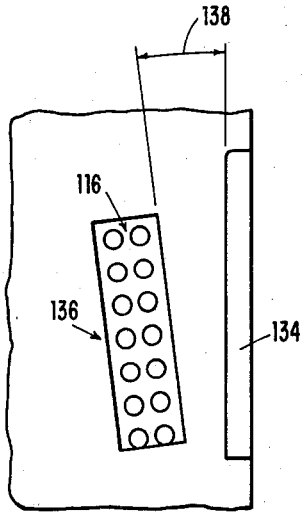
FIG. 10 shows an exploded view of the paper aligner including a vacuum transport belt and an edge alignment member.

Referring now to FIGS. 6 and 7, the utilization channel 115 includes a bottom support plate 130 and a top support plate 132. The support plates are configured with a space therebetween so that sheets which are peeled off from the stack feed readily into the channel. The bottom support plate 130 is fitted with a paper aligner and a reference guide member 134. In the preferred embodiment of this invention, the paper transport means 136 is a vacuum transport belt whose surface slightly protrudes above the surface of bottom support plate 130. The function of the reference guide member 134 is to align sheets travelling through the path. Turning to FIG. 10 for the moment, the vacuum transport belt is disposed at an angle to the edge guide element 134. In the preferred embodiment of this invention, the angle 138 which the vacuum transport belt forms with the aligning member is approximately 7°. Of course, any other type of edge alignment mechanism or a different angle of inclination may be used without departing from the scope of the present invention.

From the aligner, the paper is fed into a servo-controlled sheet handling gate assembly 118. The servo-controlled gate assembly includes a pair of feed rollers 140 and 142 (FIG. 6) respectively, mounted to a rotating shaft 144. A pair of back-up rolls mates with the feed rollers 140 and 142 respectively to form the feed nip through which the paper is fed at a controlled rate. The feed rolls cooperate with sensor 145 to form a gate (see FIG. 7). In operation, sheet position is determined by sensor 145 from which a control signal is generated which speeds up or slows down the rate of paper so that it accurately matches the proper position of a toned image on a photoconductor drum (not shown). A more detailed description of such an arrangement is given in IBM TECHNICAL DISCLOSURE BULLETIN Vol. 22, No. 12, May 1980, entitled "Servo-Controlled Paper Gate" by J. L. Cochran and J. A. Valent. Another pair of feed rollers 146 is disposed downstream from the servo-controlled gate assembly 118 and merely feeds the accelerated or decelerated sheets onto the photoconductor.

FIG. 8 shows in block diagram form, the electrical component necessary to drive the shingler 10 and a timing diagram of the shingler operation. The start shingler pulse is outputted from the utilization device, for example, a copier. The pulse is outputted on shingle conductor 147. The shingle conductor is connected to controller 148. The controller 148 can be discrete circuits joined in an appropriate manner or a microprocessor or minicomputer program in a conventional manner to generate load and unload signals on conductors 150 and 152, respectively. The signal on conductor 150 is the so-called load signal. This signal enables the system to lower the rotating member onto the stack and to separate the sheet therefrom. The signal on conductor 152 is the so-called unload signal. That signal enables the DC motor to remove shingler 10 from the stack of sheets. The signals which are outputted on conductor 150 and 152 are amplified by power amplifier or driver 154 and are fed over conductor 156 to DC motor 85. The signal which is outputted from the sensor disposed at the exit of the stack is fed over conductor 158 into controller 148. As was stated previously, this signal is used to raise shaft 32 (that is inhibit the operation of the rotary shingler). The timing diagram in FIG. 8 shows that for a positive pulse, the shingler is loading (that is contacting the stack) and for a negative pulse, the system is unloading (that is shingling of the stack is halted).

OPERATION

In operation, a stack of sheets is loaded into bin 120 (FIG. 6). The stack is aligned with edges 124 and 126 respectively. As paper is needed for transferring images from the photoconductor of a convenience copy (not shown) a signal is generated by the copier on conductor 147 (FIG. 8). Controller 148 accepts the signals and generates a load signal on conductor 150. The signal is amplified by the power driver 154 and DC motor 85 loads the shingler 10 to separate the topmost sheet from the stack. As sensor 128 senses the leading edge of the sheet, a signal is outputted on conductor 158 into controller 148. The controller processes the signal and outputs an unload control signal on conductor 152. As before, the signal on conductor 152 is amplified and is fed via power driver 154 on conductor 156 to disable the feeding of sheets from the stack. After the sheet is rotated in a counterclockwise direction to sensor 128, feed roller $\phi$1 picks the sheet and feeds it into channel 115.

While the invention has been particularly shown and described with reference to a preferred embodiment thereof, it will be understood by those skilled in the art that various changes in form and details may be made therein without departing from the spirit and scope of the invention:

What is claimed is:

1. A sheet shingling device for shingling sheets in seriatim from a stack onto a processing station of a utilization apparatus, comprising:

means operable to support a stack of sheets;

a rotary shingler member including free-rolling means disposed to contact the stack periodically, and to rotate in a plane substantially parallel to the plane of the top sheet in the stack;

force application means, comprising a pin and a coil spring connected to said pin, carried by said shingler member and disposed at the center point of a circular orbit generated by said free-rolling means, said pin being spring biased to contact the stack prior to contact by said free rolling means, to thereby impart a restraining force to said sheets prior to a shingling force being imparted to said sheets, so that sheets are shingled at a constant angle from said stack;

sheet feed means disposed relative to the stack, said sheet feed means being operable to receive the shingled sheets, and to reorientate the sheets to conform to a predetermined paper path; and sheet aligner means disposed within the paper path, said sheet aligner means being operable to align a sheet traversing said path.

2. The device of claim 1 further including servo-controlled means positioned relative to the sheet aligner means and operable to trap and to feed said sheet in timed relationship to the processing station.

3. The device of claim 1 further including motor means for rotating the shingler means.

4. The device of claim 1 further including linear power means coupled to the rotary shingler member, said power means being operable to move the shingler member and said pin in a plane substantially perpendicular to the plane of rotation of the shingler member.

5. The device of claim 1 further including sensor means disposed relative to the stack, said sensor means being operable to sense the leading edge of a shingled sheet and to output a first set of pulses.

6. The device of claim 5 further including controller means operable to accept the first set of pulses and to generate a second set of pulses for controlling said linear power means, to thereby control the positioning of said shingler member and said pin relative to the stack.

7. The sheet handling device of claim 1 wherein the sheet feed means includes a rotating shaft disposed so that its longitudinal axis runs parallel to the lengthwise dimension of the stack;

a pair of drive rollers mounted in spaced relation on said shaft;

a support shaft; and a pair of back-up rollers mounted on the support shaft, said support shaft being disposed so that the back-up rollers coact with the drive rollers to form feed nips having a contact surface substantially less than the width of a transported sheet.

8. The sheet handling device of claim 7 wherein the drive rollers have different diameters.

9. The sheet handling device of claim 1 wherein the sheet aligner means includes a paper sheet guide channel with upper and lower guide plates with the channel therebetween;

an edge aligner member operably coupled to the guide channel; and a vacuum paper feed belt positioned within the lower guide plate and disposed at an angle to the edge aligner member.

* * * * *